US006620021B2

(12) United States Patent
Liu

(10) Patent No.: US 6,620,021 B2
(45) Date of Patent: Sep. 16, 2003

(54) OSCILLATION DEVICE OF MOTION TOY

(76) Inventor: Da-Ming Liu, 5F, No. 13, Pao-Kao Road, Hsinten City (TW)

( * ) Notice: Subject to any disclaimer, the term of this patent is extended or adjusted under 35 U.S.C. 154(b) by 0 days.

(21) Appl. No.: 10/040,417

(22) Filed: Jan. 9, 2002

(65) Prior Publication Data

US 2003/0092353 A1 May 15, 2003

(30) Foreign Application Priority Data

Nov. 13, 2001 (TW) ..... 90219483 U

(51) Int. Cl.[7] ..... A63H 11/00; A63H 13/00; A63H 3/20

(52) U.S. Cl. ..... 446/330; 446/294; 446/355; 446/377

(58) Field of Search ..... 446/293, 294, 446/352, 355, 377, 390, 330, 353, 354, 356, 289, 276

(56) References Cited

U.S. PATENT DOCUMENTS 3,665,644 A * 5/1972 Rapp
4,365,437 A * 12/1982 Jameson
4,795,395 A * 1/1989 Oishi et al. ..... 446/175
4,944,708 A * 7/1990 Kawabe ..... 446/175
5,158,493 A * 10/1992 Morgrey ..... 446/355
5,281,182 A * 1/1994 Yoneda et al. ..... 446/289
5,628,668 A * 5/1997 Takemae ..... 446/355
6,036,572 A * 3/2000 Sze ..... 446/177
2002/0193045 A1 * 12/2002 Lee et al. ..... 446/330

FOREIGN PATENT DOCUMENTS

EP 0 201 626 A2 * 11/1986
GB 2 215 223 A * 9/1989
GB 2 250 214 A * 6/1992

* cited by examiner

*Primary Examiner*—Derris H. Banks
*Assistant Examiner*—Ali Abdelwahed
(74) *Attorney, Agent, or Firm*—Bacon & Thomas, PLLC

(57) ABSTRACT

An oscillation device of a motion toy includes a variety of moveable shells configured for receiving the oscillation device, a first transmission box, a first link member, and an end arcuate groove near in one of the shells. One or more cams are provided on the first transmission box. Each cam is coupled to a first shaft of the first transmission box so that during a rotation of the cams as activated by the first shaft, another shell is capable of being pushed by one cam. Hence, the cams and the first link member are operative to move together wherein the first link member moves reciprocally in the arcuate groove, thereby enabling an oscillation by the moving first link member to move the another shell.

15 Claims, 8 Drawing Sheets

OSCILLATION DEVICE OF MOTION TOY

FIELD OF THE INVENTION

The present invention relates to toys and more particularly to an oscillation device motion toy with improved characteristics.

BACKGROUND OF THE INVENTION

In the past all toys whether shaped like a cat, dog, or human being are motionless. As technology advances and the needs of consumers change, a variety of motion toys are commercially available. Such motion toys are more interesting than motionless ones and are popular.

However, conventional motion toys suffered from several disadvantages. For example, its mechanism is too complex due to excessive number of components. Hence, a single malfunctioning component can cause the whole motion toy to be inoperable, reducing reliability. Moreover, the manufacturing cost of such toy increases as the number of components increases. Further, such motion toy is awkward in operation because a combined motion of some components may be partially or even totally compromized by a single inoperable component thereof. As a result, after a short period of time of use, motion toys may become easily inoperable due to malfunction.

Thus, it is desirable to provide a durable, reliable, aesthetically pleasing, and playful motion toy which has an improved oscillation device in order to overcome the above drawbacks of the prior art.

SUMMARY OF THE INVENTION

It is therefore an object of the present invention to provide an oscillation device of a motion toy including a variety of moveable shells for receiving the oscillation device. The oscillation device comprises a first transmission box, a first link member, and an end arcuate groove near one of the shells wherein the first link member is capable of pivotably coupling to the first transmission box within a moving distance defined by the arcuate groove, and the other end of the first link member is fixed to another one of the shells. One or more cams are provided on the first transmission box. Each cam is coupled to a first shaft of the first transmission box so that during rotation of the cams when activated by the first shaft, another shell is capable of being pushed by one cam. Hence, the cams and the first link member are operative to move together wherein the first link member moves reciprocally in the arcuate groove to enable an oscillation motion by the moving first link member to move another shell.

The above and other objects, features and advantages of the present invention will become apparent from the following detailed description taken with the accompanying drawings.

DETAILED DESCRIPTION OF THE PREFERRED EMBODIMENTS

Figure 1:
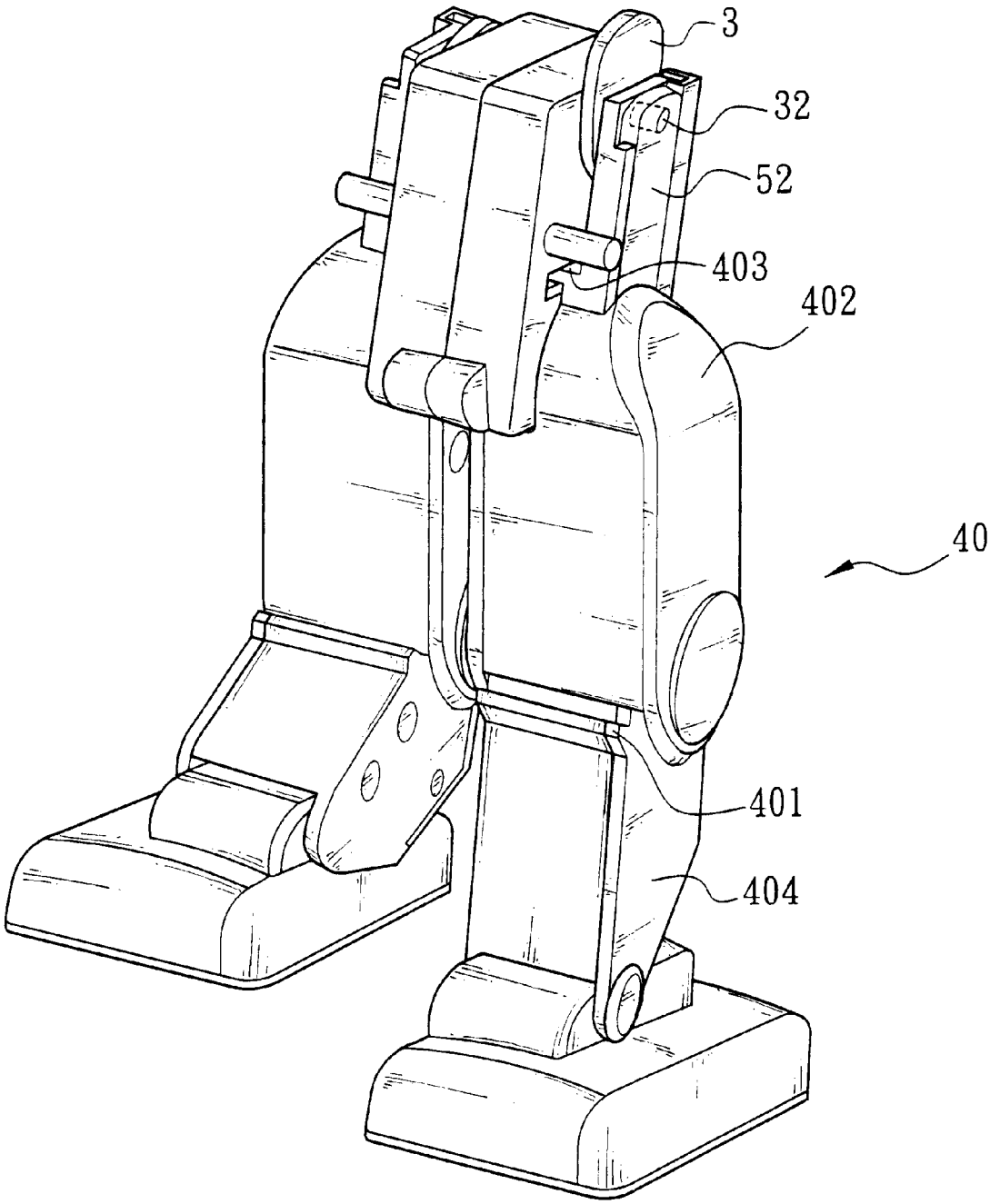
FIG. 1 is a perspective view of a preferred embodiment of a portion of the motion toy according to the invention.
Figure 2:
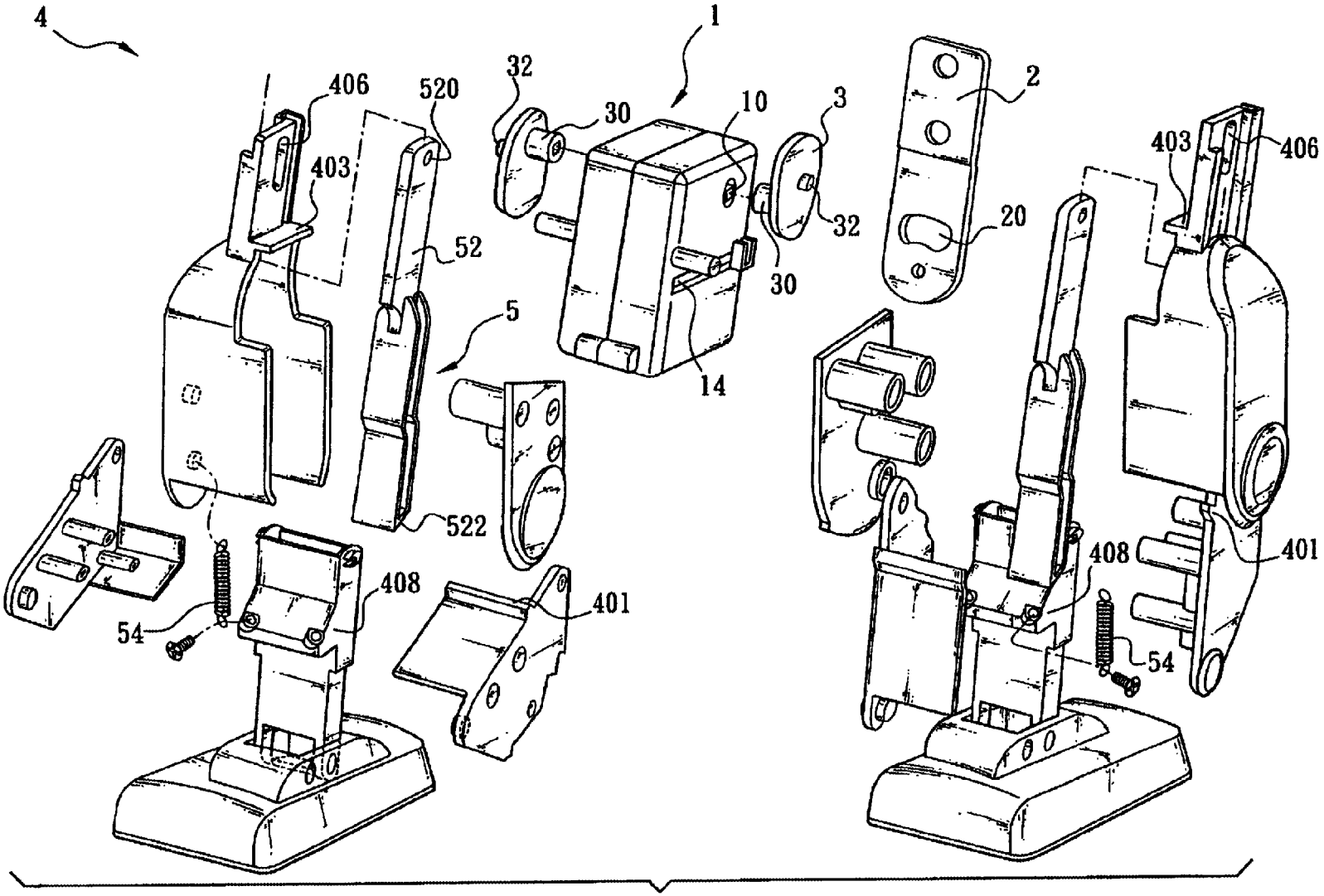
FIG. 2 is an exploded view of FIG. 1.
Figure 7:
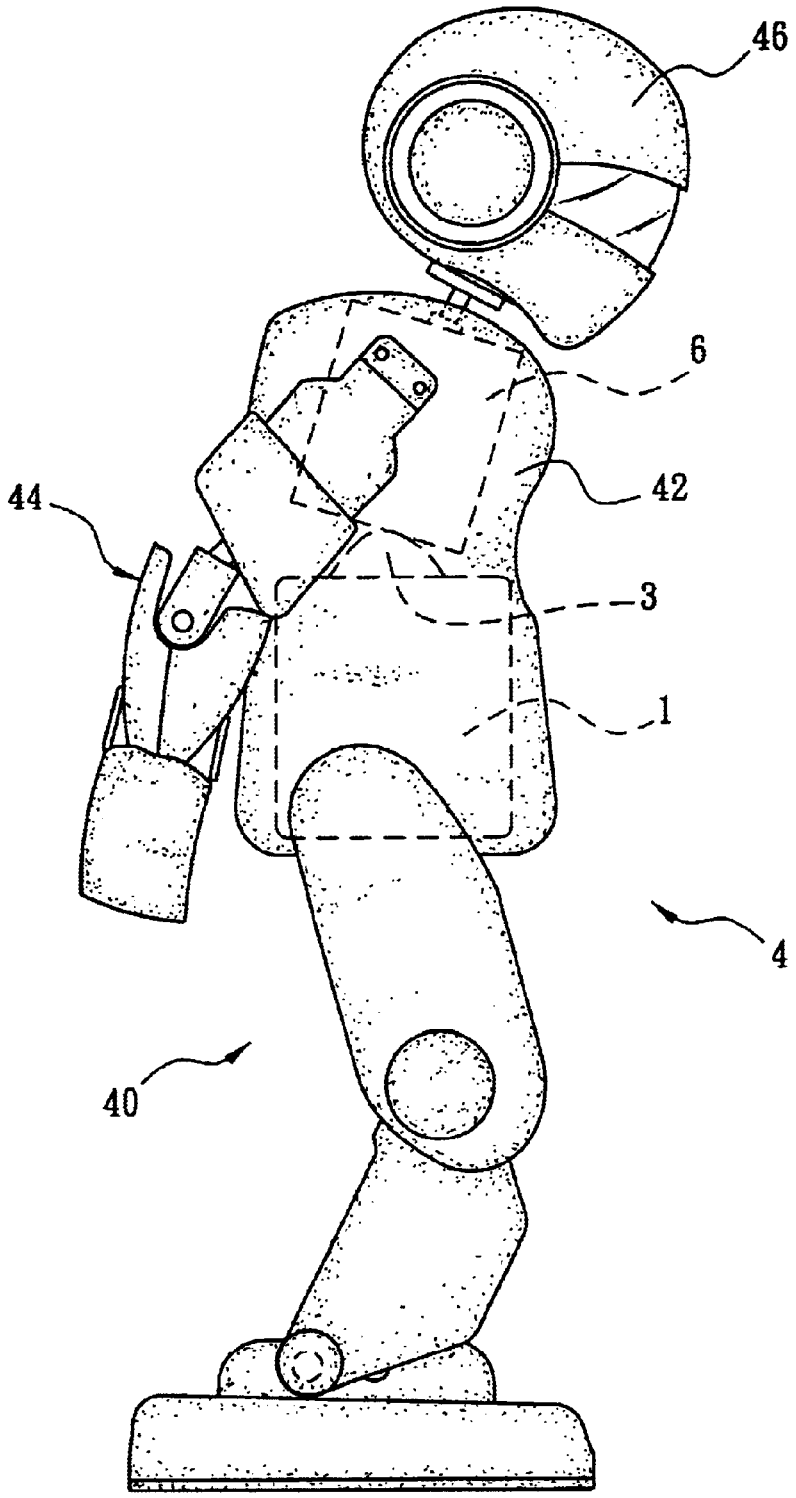
FIG. 7 is a side view of a complete motion toy according to the invention.

Referring to FIGS. 1, 2 and 7, there is shown a moveable portion of motion toy (e.g., head shell 46, hand shells 44, leg shells 40, body shell 42, etc.) constructed in accordance with the invention. Such moveable portion is comprised of a variety of shells with an oscillation device installed therein. The shells comprise a first transmission box 1 and a first link member 2 including an arcuate groove 20 near one end so that the first link member 2 can be pivotably coupled to first transmission box 1 with movement defined by the arcuate groove 20. The other end of first link member 2 is fixed to another shell.

In the first transmission box 1, there is provided a drive (gear mechanism 60 shown in FIG. 8) and a first shaft 10 rotatably coupled to the drive. First shaft 10 has two ends projected from the first transmission box 1. Either one of two cams 3 has a first connection member 30 on its inner side rotatably sleeved on the first shaft 10. In other words, cam 3 can be eccentrically rotated by the first shaft 10. During the rotation of the cams 3, an edge thereof may move to a position higher or lower than a top surface of the first transmission box 1. Also, when the edge of cams 3 move above the top surface of the first transmission box 1 another shell can be pushed by the cam 3. Hence, the cam 3 and the first link member 2 can move together so that the first link member 2 moves reciprocally in the arcuate groove 20. As a result, an oscillation is effected by moving the first link member 2 and another shell.

Referring to FIGS. 1 and 7 specifically, in an embodiment of the invention the motion toy is a robot 4 wherein the shells are formed as two leg shells 40 of a robot 4. Other shells are formed as an upper part of the robot's body shell 42. Also, two hand shells 44 are formed on both sides of the upper part of the body shell 42 of robot 4. A head shell 46 is formed on a top end of the upper part of body shell 42 while the bottom end of the body shell 42 is coupled to the leg shells 40. First transmission box 1 is coupled between the leg shells 40. Two ends of first shaft 10 are projected from the first transmission box 1 corresponding to the leg shells 40. Either cam 3 is provided on an end of the first shaft 10 just between leg shells 40 and first transmission box 1. Cams 3 are positioned at opposite ends of the first shaft 10. That is, as one cam 3 moves above the top of the first transmission box 1 the other cam 3 moves below the top of first transmission box 1. Hence, cams 3 can alternately move the upper part of body shell 42. Either end of the arcuate groove 20 is bent towards the leg shells 40.

Referring to FIGS. 2 to 6, a stopper block 12 is provided on one side of first transmission box 1 and abutted to the arcuate groove 20. Hence, first link member 2 can move along arcuate groove 20 back and forth in cooperation with stopper block 12 when cams 3 push the upper part of the body shell 42. As a result, the upper part of body shell 42 can oscillate to the left and right in a cyclic manner. A second connection member 32 is provided on an outer side of either cams 3 facing the leg shell 40. First and second connection members 30 and 32 of cam 3 are not aligned. Second connection member 32 is coupled to a second link member 5 in leg shells 40. As such, during a rotation of the cams 3, not only does the upper part of body shell 42 move to generate an oscillation by the cams 3 but also the leg shells 40 can move by the movement of the second connection member 32 and the follower second link member 5. As a result, leg shells 40 move forward step by step.

Figure 4:
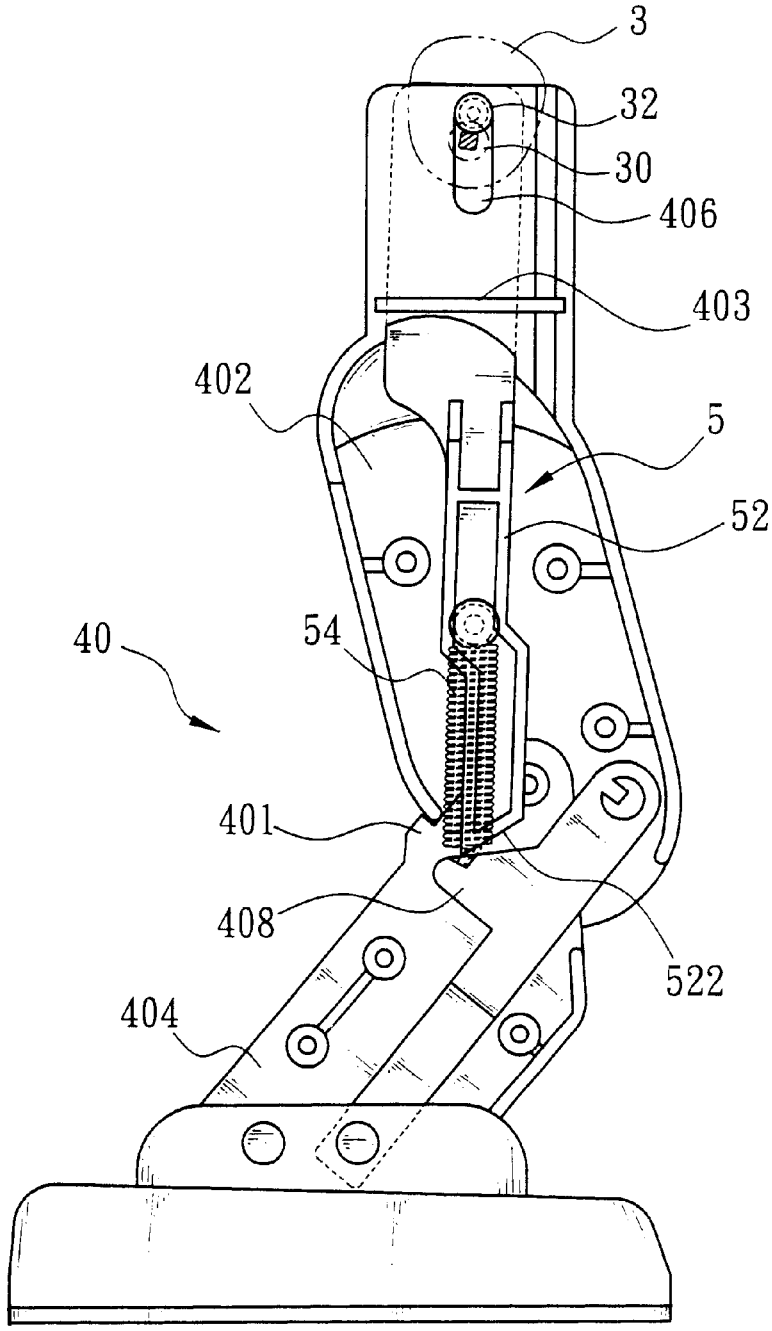
FIG. 4 is a side view schematically showing a movement performed by a second link member.
Figure 5:
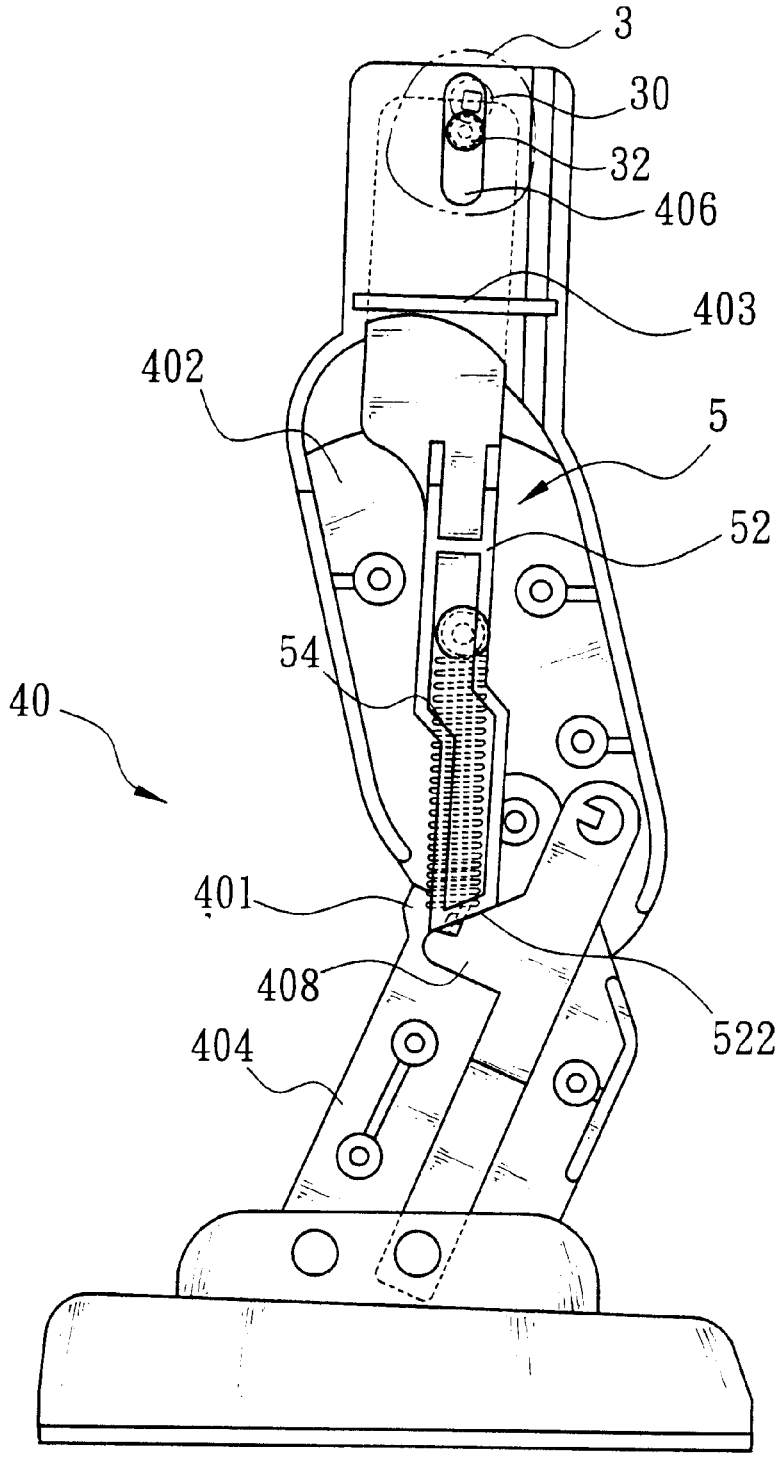
FIG. 5 is a view similar to FIG. 4 showing another movement performed by second link member.

Referring to FIGS. 4 and 5 specifically, each leg shell 40 consists of a first moveable section 402 and a second moveable section 404. First moveable section 402 is coupled to one side of first transmission box 1. First moveable section 402 comprises an upper longitudinal limit trough 406. Second moveable section 404 is obliquely pivotably coupled to first moveable section 402. One end of the second moveable section 404 adjacent the first moveable section 402 is formed as a slant 408 obliquely from one inner end towards the other outer end of first moveable section 402. A flange 401 is formed adjacent a free end of slant 408 and urged against one end of the first moveable section 402. Second link member 5 is located in the leg shells 40 and comprises a link plate 52 and an elastic member 54. The link plate 52 is located in the first moveable section 402 and comprises an upper hole 520 corresponding to the second connection member 32. The second connection member 32 has a cylindrical shape that is inserted through the hole 520 of the link plate 52 and into the limit trough 406. Another slant 522 is formed on the link plate 52 and mated with the slant 408. Upper end of the elastic member 54 is anchored at the link plate 52 while the other end is anchored at the second moveable section 404. During rotation of cams 3, the link plate 52 is given an alternate movement in a range defined by the limit trough 406 as the second connection member 32 rotates. Consequently, another slant 522 slides along the surface of the slant 408 to decrease an oblique angle between the first and second moveable sections 402 and 404. As a result, an alternate lift of the leg shells 40 is carried out.

Figure 6:
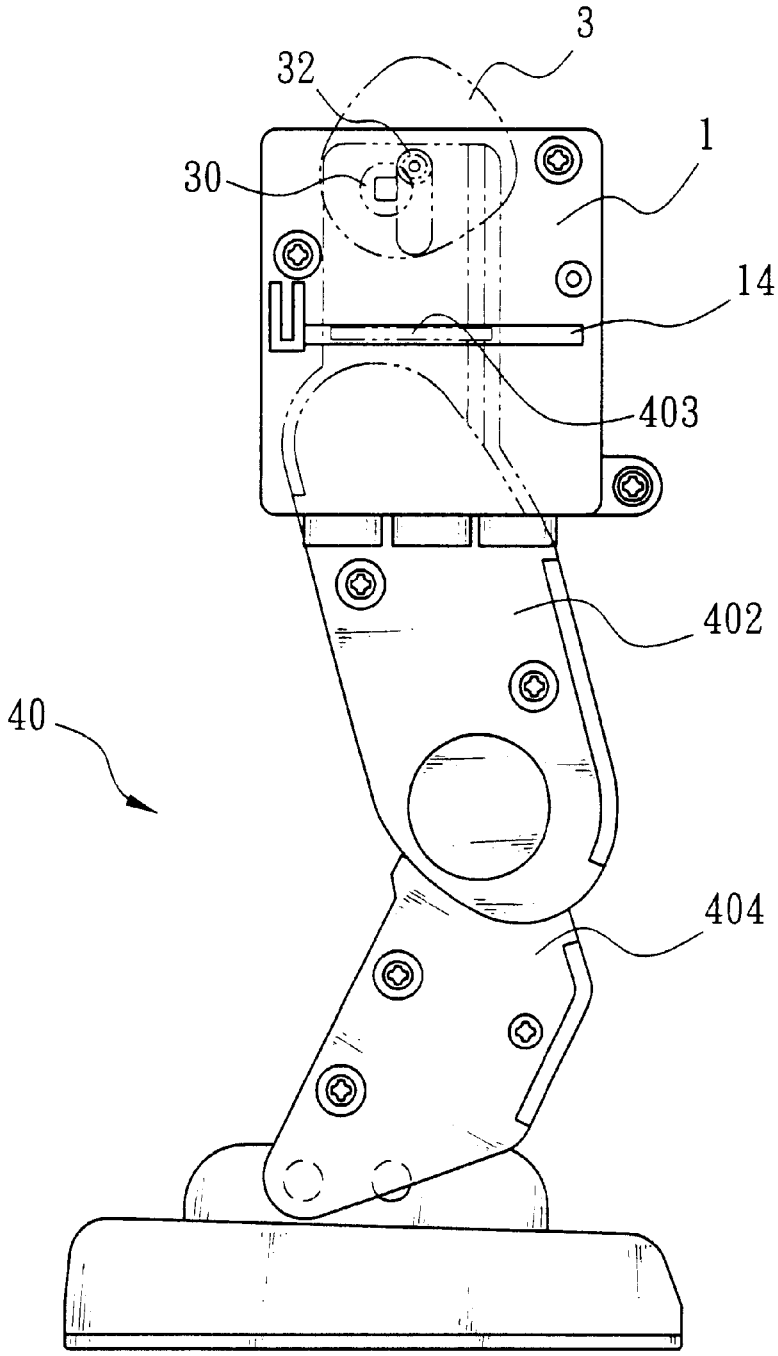
FIG. 6 is a side view schematically showing an engagement of rail and groove.

Referring to FIGS. 2 and 4 specifically, a groove 14 is formed on either side of the first transmission box 1 facing the first moveable section 402. The provision of grooves 14 does not affect a rotation of cams 3. Correspondingly, a rail 403 is formed at the first moveable section 402 slidable in the groove 14. When the rail 403 slides in the groove 14, an oblique angle between first and second moveable sections 402 and 404 is decreased. Hence, during the lift of moveable sections 402 and 404, rails 403 are activated to slide in the grooves 14 (FIG. 6). As a result, the leg shells 40 move forward step by step.

Figure 3:
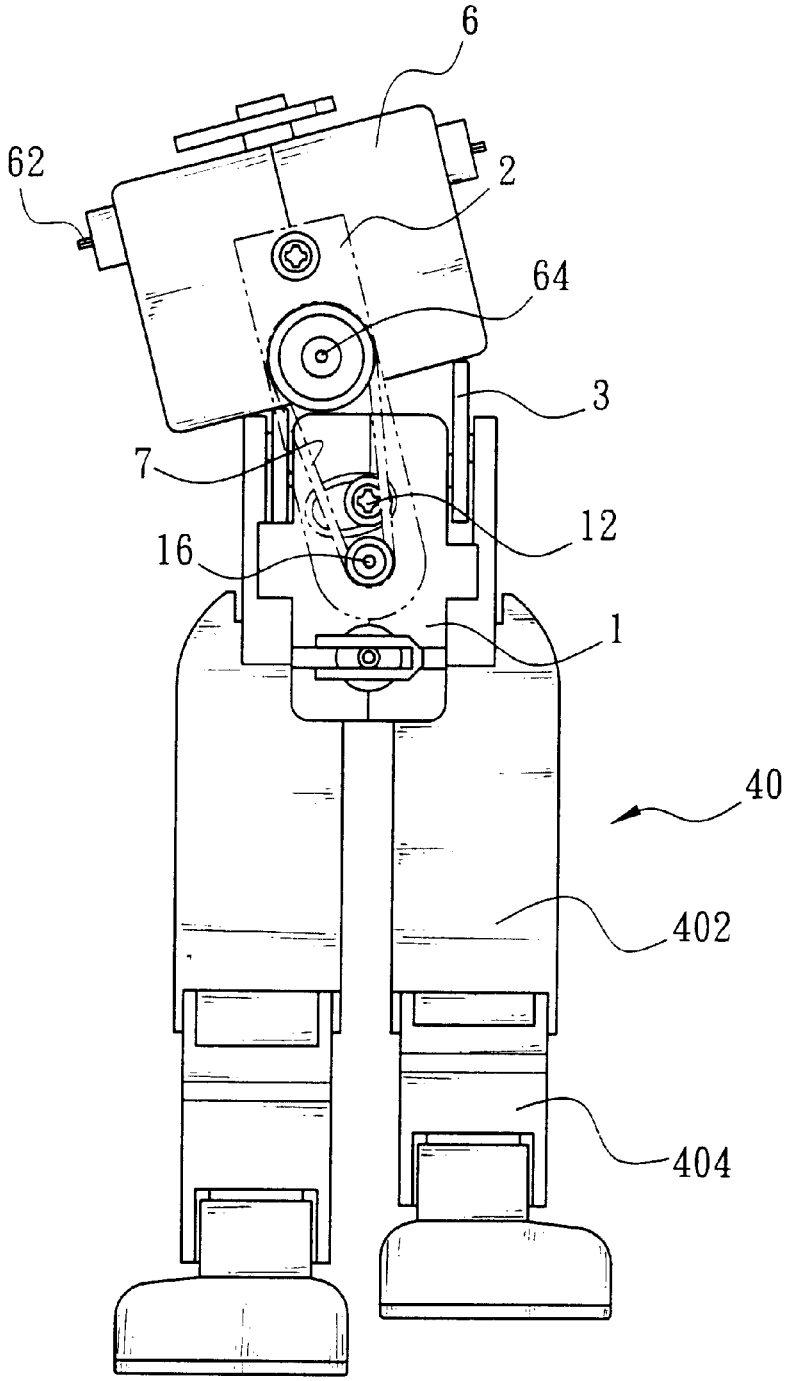
FIG. 3 is a front view schematically showing a movement by an cooperation of two transmission boxes and leg shells of the inventive device.
Figure 8:
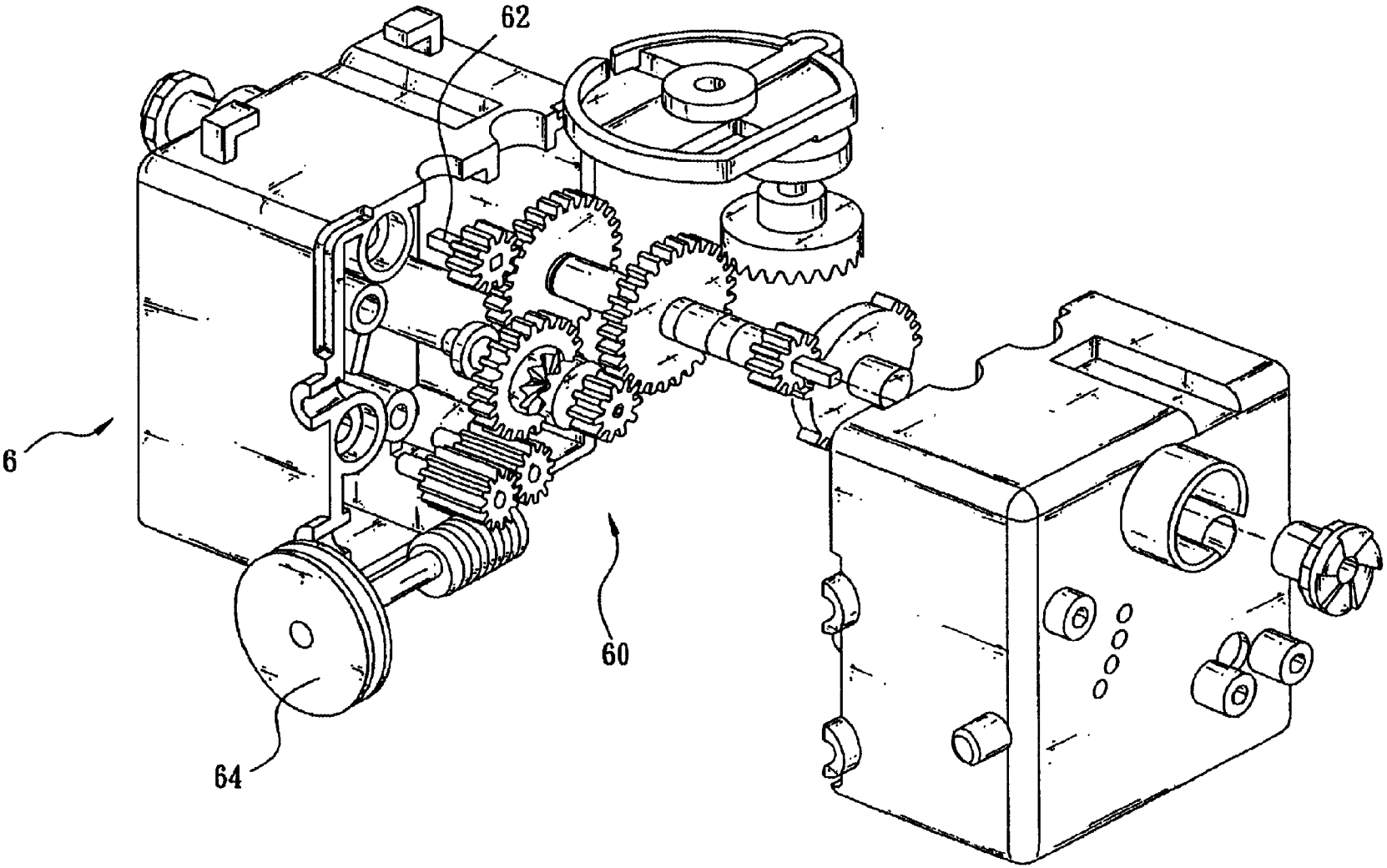
FIG. 8 is a partially exploded view of a transmission box of the invention.

Referring to FIG. 3 specifically, in another embodiment of the invention a second transmission box 6 is provided in and coupled to the body shell 42 (shown in FIG. 7). First link member 2 is fixed to and separated from the second transmission box 6 by a gap. When one cam 3 moves above the top of transmission box 1 the other cam 3 moves second transmission box 6 to face one side of first transmission box 1. Hence, second transmission box 6 oscillates and so does the body shell 42. A second shaft 62 is projected from one side of the second transmission box 6 facing the hand shell 44 (shown in FIG. 7). Second shaft 62 is coupled to a third link member (not shown) in the hand shell 44. Hence, a rotation of the second shaft 62 can cause the hand shells 44 to oscillate. As shown in FIG. 8, the second gear transmission box 6 includes a gear mechanism 60.

In the embodiment shown in FIG. 3, the first transmission box 1 further comprises a projected third shaft 16. The second transmission box 6 further comprises a projected fourth shaft 64. A power transmission member 7 is provided between the third and fourth shafts 16 and 64. In this embodiment power transmission member 7 is implemented as a belt, while it is appreciated by those skilled in the art that the belt may be replaced by another suitable element without departing from the scope and spirit of the invention. Power of the drive is transmitted from the third shaft 16 to the fourth shaft 64 through a power transmission member 7 adapted for rotating a gear mechanism 60 (shown in FIG. 8) inside the second transmission box 6. In this embodiment, a gear mechanism 60 having various gears is provided in each of the first and second transmission boxes 1 and 6. First shaft 10 of the first transmission box 1 and the second shaft 62 of the second transmission box 6 are coupled to the cams 3, the second link member 5, and a third link member by coupling the gear mechanisms together. Further, via operation of the cams 3, the second link member 5, and the third link member can be thus controlled. The gear mechanisms of transmission boxes 1 and 6 are specially designed depending on the desired movements of the various shells. Furthermore, specific gear mechanisms used in a motion toy are well known. For example, they are disclosed in Taiwanese Patent Application Nos. 89,217,949 and 90,212,784. Since they are not the subject of the invention, a detailed description thereof is omitted herein for the sake of brevity.

As stated above, the motion toy (e.g., robot) of the invention can perform oscillation, leg lift, and step forward actions with cooperation of cams 3, second transmission box 6, and link plate 52 as well as a sliding movement of rail 403 along groove 14. This contrasts to conventional motion toys which are disadvantageous for being awkward and incapable of performing oscillation, leg lift, and step forward actions. In addition, such oscillation including details of leg lift, and step forward actions as well as an execution order can be precisely obtained by trial and error in order to produce cams 3 having an exact shape as well as locations of first and second connection members 30 and 32. As a result, consumers' needs can be fulfilled. The design of cam 3 as well as locations of first and second connection members 30 and 32 can be determined by trial and error and thus a detailed description thereof is omitted herein for the sake of brevity.

While the invention has been described by means of specific embodiments, numerous modifications and variations could be made thereto by those skilled in the art without departing from the scope and spirit of the invention set forth in the claims.

What is claimed is:

1. An oscillation device of a motion toy including a variety of moveable shells for receiving the oscillation device, the oscillation device comprising:

a first transmission box positioned in one of the shells and including one or more cams and a first shaft coupled to either one of the cams so that during a rotation of the cams as activated by the first shaft, an edge of either one of the cams is capable of moving to a position higher or lower than a top surface of the first transmission box; and a first link member including an arcuate groove near one end so that the first link member is capable of pivotably coupling to the first transmission box within a moving distance defined by the arcuate groove, another end of the first link member being fixed to another one of the shells so that when the edge of either one of the cams moves above the top surface of the first transmission box another one of the shells is capable of being pushed by either one of the cams, the cams and the first link member are operative to move together wherein the first link member moves reciprocally in the arcuate groove, thereby enabling an oscillation by the first link member to move the another one of the shells.

2. The oscillation device of claim 1, further comprising a drive in the first transmission box rotatably coupled to the first shaft, the first shaft having at least one end projected from the first transmission box wherein each cam includes a first connection member on its inner side rotatably sleeved on the first shaft so that each cam is capable of giving an eccentric rotation to the first shaft.

3. The oscillation device of claim 1, wherein:

the motion toy is a robot;

the shells are formed as two leg shells of the robot, an upper part of a body shell of the robot, two hand shells on both sides of the upper part of the body shell, and a head shell on a top end of the upper part of the body shell with a bottom end of the body shell coupled to the leg shells;

the first transmission box is coupled between the leg shells and further comprises a stopper block on one side abutting the arcuate groove;

two ends of the first shaft are projected from the first transmission box corresponding to the leg shells;

each cam is provided on an end of the first shaft just between the leg shells and the first transmission box;

the cams are opposite with respect to the first shaft wherein one of the cams moves above the top surface of the first transmission box another one of the cams moves below the top surface of the first transmission box, thereby causing the cams to alternately move the upper part of the body shell; and either end of the arcuate groove is bent toward the leg shells so that the first link member is capable of moving along the arcuate groove back and forth in cooperation with the stopper block when the cams push the upper part, of the body shell, thereby, causing the upper part of the body shell to oscillate left and right cyclically.

4. The oscillation device of claim 2, further comprising a second connection member on an outer side of either one of the cams facing the leg shells wherein the first connection member and the second connection member is not aligned, a second link member in the leg shells coupled to the second connection member so that during the rotation of the cams, not only the upper part of the body shell is capable of moving to generate an oscillation by the cams but also the leg shells are capable of moving by the movement of the second connection member and the second link member thereby causing the robot to move forward.

5. The oscillation device of claim 4, wherein each leg shell comprises:

a first moveable section coupled to one side of the first transmission box and including a longitudinal limit trough;

a second moveable section obliquely pivotably coupled to the first moveable section and including a first slant at one end adjacent the first moveable section, the first slant being oblique from one inner end toward an outer end of the first moveable section, and a flange adjacent a free end of the first slant urged against one end of the first moveable section;

the second link member located in the second moveable section and including:

a link plate located in the first moveable section and including a hole corresponding to the second connection member so as to insert the second connection member through the hole into the limit trough, and a second slant formed on the link plate mated with the first slant; and an elastic member having one end anchored at the link plate and the other another end anchored at the second moveable section;

wherein during the rotation of the cams, the link plate is given an alternate movement in a range defined by the limit trough as the second connection member rotates, the second slant slides along a surface of the first slant to decrease an oblique angle between the first and the second moveable sections, and causes the leg shells to lift alternately.

6. The oscillation device of claim 5, further comprising a groove formed on either side of the first transmission box facing the first moveable section without affecting the rotation of the cams, and a rail formed at the first moveable section slidable in the groove wherein when the rail slides in the groove, an oblique angle between the first and the second moveable sections is decreased, during a lift of the moveable sections, the rail is activated to slide in the groove, and cause the leg shells to move forward step by step.

7. The oscillation device of claim 3, further comprising a second transmission box provided in and coupled to the body shell wherein the first link member is fixed to and separated from the second transmission box by a predetermined gap so that when one of the cams moves above the top surface of the first transmission box another one of the cams moves the second transmission box to face one side of the first transmission box, thereby causing the second transmission box to oscillate.

8. The oscillation device of claim 7, further comprising a second shaft projected from one side of the second transmission box facing one of the hand shells, and a third link member in one of the hand shells coupled to the second shaft wherein a rotation of the second shaft causes the hand shells to oscillate.

9. The oscillation device of claim 8, wherein the first transmission box further comprises a projected third shaft, and the second transmission box further comprises a projected fourth shaft, further comprising a power transmission member between the third and the fourth shafts adapted to transmit power from the third shaft to the fourth shaft therethrough for rotating a gear mechanism in the second transmission box.

10. An oscillation device of a motion toy implemented as a robot including an upper part of a body shell, two hand shells on both sides of the upper part of the body shell, a head shell on a top end of the upper part of the body shell, and two leg shells coupled to a bottom end of the body shell, the oscillation device being received between the leg shells and the upper part of the body shell, the oscillation device comprising:

a first transmission box positioned between the leg shells and including a first shaft having two ends projected from both sides of the first transmission box facing the leg shells;

two cams each including a first connection member on its inner side rotatably sleeved on the first shaft for enabling each cam to give an eccentric rotation to the first shaft so that during a rotation of the cams as activated by the first shaft, an edge of one of the cams is capable of moving to a position higher or lower than a top surface of the first transmission box, and a second connection member on an outer side of one of the cams facing the leg shells, the first and the second connection members are not aligned; and a second link member in the leg shells coupled to the second connection member so that during the rotation of the cams, the leg shells are capable of moving by the movement of the second connection member and the second link member, thereby causing the robot to move forward.

11. The oscillation device of claim 10, wherein each leg shell comprises:

a first moveable section coupled to one side of the first transmission box and including a longitudinal limit trough;

a second moveable section obliquely pivotably coupled to the first moveable section and including a first slant at one end adjacent the first moveable section, the first slant being oblique from one inner end toward an outer end of the first moveable section, and a flange adjacent a free end of the first slant urged against one end of the first moveable section;

the second link member located in the leg shells and including:

a link plate located in the first moveable section and including a hole corresponding to the second connection member so as to insert the second connection member through the hole into the limit trough, and a second slant formed on the link plate mated with the first slant; and an elastic member having one end anchored at the link plate and another end anchored at the second moveable section;

wherein during the rotation of the cams, the link plate is given an alternate movement in a range defined by the limit trough as the second connection member rotates, the second slant slides along a surface of the first slant to decrease an oblique angle between the first and the second moveable sections, and causes the leg shells to lift alternately.

12. The oscillation device of claim 11, further comprising a groove formed on either side of the first transmission box facing the first moveable section without affecting the rotation of the cams, and a rail formed at the first moveable section slidable in the groove wherein when the rail slides in the groove, an oblique angle between the first and the second moveable sections is decreased, during a lift of the moveable sections, the rail is activated to slide in the groove, and cause the leg shells to move forward step by step.

13. The oscillation device of claim 10, further comprising a second transmission box provided in and coupled to the body shell wherein a first link member is fixed to and separated from the second transmission box by a predetermined gap so that when one of the cams moves above the top surface of the first transmission box another one of the cams moves the second transmission box to face one side of the first transmission box, thereby causing the second transmission box to oscillate.

14. The oscillation device of claim 13, further comprising a second shaft projected from one side of the second transmission box facing one of the hand shells, and a third link member in one of the hand shells coupled to the second shaft wherein a rotation of the second shaft causes the hand shells to oscillate.

15. The oscillation device of claim 14, wherein the first transmission box further comprises a projected third shaft, and the second transmission box further comprises a projected fourth shaft, further comprising a power transmission member between the third and the fourth shafts so as to transmit power from the third shaft to the fourth shaft therethrough for rotating a gear mechanism in the second transmission box.

* * * * *